United States Patent [19]

Schlatter et al.

[11] 4,168,159

[45] Sep. 18, 1979

[54] HIGH SPEED STEELS WITH PHOSPHORUS FOR IMPROVED CUTTING PERFORMANCE

[75] Inventors: René Schlatter, Latrobe; David P. Hughes, Ligonier; James Stepanic, Latrobe, all of Pa.

[73] Assignee: Latrobe Steel Company, Latrobe, Pa.

[21] Appl. No.: 882,179

[22] Filed: Feb. 28, 1978

[51] Int. Cl.[2] ..... C22C 38/22; C22C 38/24

[52] U.S. Cl. ..... 75/126 C; 75/126 E; 75/126 H; 75/126 K

[58] Field of Search ..... 75/126 K, 126 A, 126 C, 75/126 E, 126 H

[56] References Cited

U.S. PATENT DOCUMENTS

| | | | |
|---|---|---|---|
| 2,983,601 | 5/1961 | Fletcher | 75/126 H |
| 3,113,862 | 12/1963 | Harvey et al. | 75/126 C |
| 3,259,489 | 7/1966 | Hamaker, Jr. et al. | 75/126 K |
| 3,295,401 | 1/1967 | Raekoff | 75/126 E |
| 3,859,081 | 1/1975 | Harvey et al. | 75/126 E |

FOREIGN PATENT DOCUMENTS

| | | | |
|---|---|---|---|
| 48-7180 | 3/1973 | Japan | 75/126 C |

*Primary Examiner*—Arthur J. Steiner
*Attorney, Agent, or Firm*—Buell, Blenko & Ziesenheim

[57] ABSTRACT

A new high speed steel with improved cutting life is provided consisting essentially of about 0.7 to 1.6% carbon, about 0.2 to 1.0% silicon, about 0.2 to 0.8% manganese, up to about 0.2% sulphur, about 0.5 to about 20% tungsten, about 0.5 to about 10% molybdenum, about 0.5 to 5% chromium, about 0.5 to about 6% vanadium, up to about 10% cobalt, more than 0.03% to about 0.20% phosphorus, the balance iron with residual impurities in ordinary amounts.

6 Claims, No Drawings

HIGH SPEED STEELS WITH PHOSPHORUS FOR IMPROVED CUTTING PERFORMANCE

This invention relates to high speed steels with improved cutting performance and particularly to high speed steels having phosphorus contents in excess of those generally heretofore believed to be acceptable and which impart these new improved cutting performance characteristics.

High speed steels have, in the past, been made for a wide variety of cutting applications and they have been made to very tight chemical composition standards especially in regard to certain residual elements. Traditionally, phosphorus has always been considered an impurity which will create detrimental effects on hot ductility as well as on the properties and cutting ability of high speed tool steels. Phosphorus levels have therefore in the past been tightly limited in higher alloy steels and in most commercial specifications have been limited to a maximum of 0.025 to 0.030% in order to avoid workability, property and performance problems in the resulting alloy. All prior art field tests known to the applicants have shown that increased phosphorus contents appear to result in reduced material toughness and early tool breakage, particularly chipping of the teeth on cutters. For these reasons, high speed steel specifications have generally, in the past, not allowed phosphorus contents in excess of a level of about 0.03%. Furthermore, it has been considered in the prior art that elevated phosphorus contents would decrease hot ductility properties which would in turn lead to forgeability difficulties and to lower yields in the final product. In short, it has been the teaching in the prior art that phosphorus contents in excess of 0.03% should be avoided. We have discovered in tests conducted over a considerable period of time that contrary to these earlier and common beliefs, phosphorus within a narrow range in excess of that considered to be detrimental in the past is not in fact detrimental but can actually exert a beneficial effect on tool performance in cutting applications without impairing mechanical properties.

We have found, however, that it is mandatory that the optimum phosphorus range be maintained to avoid manufacturing problems and associated economic losses. Specifically, we have discovered that molybdenum base and tungsten molybdenum base high speed steels can tolerate markedly increased residual phosphorus contents than those hitherto believed acceptable. To the contrary, we have actually found that there is a significant improvement in cutting capacity of various tool steels as well as no loss in heat treatment response or mechanical properties. We have found that the upper limit of phosphorus in these high speed steels basically is determined by an increasing degradation of their hot ductility in the range of the usual working temperatures for forging and rolling. Lower working temperatures can, we have found, counteract the influence of phosphorus to some degree but the reduced hot workability does result in additional working operations and higher material losses. Generally, we have found that there is no measurable effect of a moderately elevated phosphorus content in the range 0.08 to 0.12% on the heat treatment response, the maximum hardness after quenching and tempering, the retained austenite or the grain size. We have found no changes in microstructural features in any of the materials investigated by us up to 0.12% phosphorus. We have found by way of face milling tests performed with M1 molybdenum-base and M2 tungsten-molybdenum-base high speed tool steels containing high phosphorus according to this invention in which longer tool lives were obtained with the increased phosphorus contents. These improvements are particularly significant at lower and medium feed rates, amounting to an average increase in tool life of 10% to over 30%. We have found in drilling tests made with a high carbon molybdenum high speed steel M10, a significant improvement in the number of holes drilled with drills manufactured from the high phosphorus material of this invention. The increase in drill life ranged from 20 to over 40%, depending on the feed rate employed.

In general, an alloy according to our invention would have the following broad composition range: 0.7 to 1.6% carbon, 0.2 to 1.0% silicon, 0.2 to 0.8% manganese, up to 0.2% sulphur, 0.5 to 20% tungsten, 0.5 to 10% molybdenum, 0.5 to 5% chromium, 0.5 to 6% vanadium, up to 10% cobalt, more than 0.03 to 0.20% phosphorus.

We have found that the optimum cutting tool life is obtained with these high speed steel compositions containing 0.04 to 0.09 percent phosphorus.

While we have set out certain objects and purposes of this invention in the foregoing general disclosure, we believe that the invention will be more clearly understood by the following examples which illustrate the specific life improvements achieved with elevated phosphorus contents in high speed steels contrary to the teachings of the prior art.

EXAMPLE I

High speed steels (M1) containing 0.83% carbon, 8.3% molybdenum, 3.5% chromium, 1.9% tungsten and 1.0% vanadium and having a phosphorus content of 0.028% in one specimen and 0.103% in another specimen were manufactured into tool bits for single tooth face milling tests. Hardness after full heat treatment in both was 64.0 to 64.5 $R_c$. The cutting speed was constant at 15.2 meters per minute but the feed rate was varied. The work material was 4340 steel at a hardness of 321 BHN. These tests were continued until localized wear on the cutting edge reached 1.52 mm.

The following tool life in minutes was reported:

| | 0.028%P | 0.103%P |
|---|---|---|
| 0.25 mm Feed Rate/Tooth | 141 min. | 198 min. |
| 0.76 mm Feed Rate/Tooth | 54 min. | 86 min. |
| 1.27 mm Feed Rate/Tooth | 47 min. | 56 min. |

EXAMPLE II

The same tests as in Example I were repeated with an M2 high speed steel of the following composition: 0.88% carbon, 6.0% tungsten, 4.0% chromium, 4.8% molybdenum, 1.8% vanadium and phosphorus contents of 0.023%, 0.066% and 0.104%. The hardness of the fully hardened tool bits was 64.5–65.0 $R_c$.

Tool test data reported were:

| | 0.023%P | 0.066%P | 0.104%P |
|---|---|---|---|
| 0.25 mm Feed Rate/Tooth | 122 min. | 188 min. | 188 min. |
| 0.76 mm Feed Rate/Tooth | 78 min. | 86 min. | 94 min. |
| 1.01 mm Feed Rate/Tooth | 59 min. | 65 min. | 65 min. |

EXAMPLE III

Drill testing was performed with 12.7 mm diameter drills made of high carbon M10 high speed steel of the following composition: 0.96% carbon, 7.8% molybdenum, 4.2% chromium, 0.7% tungsten, 1.9% vanadium with phosphorus contents of 0.021% and 0.066%, respectively. The drills were heat treated to a hardness of 64.5 to 65.0 $R_c$. Test conditions were: 450 RPM, feed rate 152–165 mm/min., work material AISI 4150 steel at 25 $R_c$ hardness. The following average number of holes were drilled:

| | 0.021%P | 0.066%P |
|---|---|---|
| 140 mm Feed Rate/min. | 153 | 194 |
| 152 mm Feed Rate/min. | 67 | 96 |
| 165 mm Feed Rate/min. | 56 | 85 |

The foregoing tests show the improved cutting ability of the high phosphorus containing high speed steels of this invention. In the case of Example I from 20% to almost 60% improvement in tool life was experienced depending upon the feed rate. In Example II the improvement varied from about 20% to 50% as did the tools in Example III. It is thus clear that the high phosphorus content provided in the alloys of this composition far from being detrimental as taught by the prior art actually provides an improved tool life.

In the foregoing specification we have set out certain preferred practices and embodiments of our invention, however, it will be understood that this invention can be otherwise practiced within the scope of the following claims.

We claim:

1. A high phosphorous high speed steel with improved cutting life consisting essentially of about 0.7 to 1.6% carbon, about 0.2 to 1.0% silicon, about 0.2 to 0.8% manganese, up to about 0.2% sulphur, about 0.5 to about 20% tungsten, about 0.5 to about 10% molybdenum, about 0.5% to 5% chromium, about 0.5 to about 6% vanadium, up to about 10% cobalt, sufficient phosphorous in the range more than 0.03% to about 0.20% phosphorous, to provide improved cutting tool life as compared with a like alloy having less than 0.03% phosphorous, the balance iron with residual impurities in ordinary amounts.

2. A high speed steel according to claim 1 having 0.04 to 0.09% phosphorus.

3. A high speed steel according to claim 1 consisting essentially of 0.83% carbon, 8.3% molybdenum, 3.5% chromium, 1.9% tungsten, 1.0% vanadium and 0.103% phosphorus and the balance iron with residual impurities in ordinary amounts.

4. A high speed steel as claimed in claim 1 consisting essentially of 0.80% carbon, 6.0% tungsten, 4.0% chomium, 4.8% molybdenum, 1.8% vanadium, phosphorus between about 0.066% and 0.104% and the balance iron with residual impurities in ordinary amounts.

5. A high speed steel according to claim 1 consisting essentially of 0.96% carbon, about 7.8% molybdenum, about 4.2% chromium, about 0.7% tungsten, about 1.9% vanadium, about 0.066% phosphorus and the balance iron with residual impurities in ordinary amounts.

6. A high speed cutting tool made of an alloy consisting essentially by weight of about 0.7 to 1.6% carbon, about 0.2 to about 1.0% silicon, about 0.2 to about 0.8% manganese, up to about 0.2% sulphur, about 0.5 to about 20% tungsten, about 0.5 to about 10% molybdenum, about 0.5 to about 5% chromium, about 0.5 to about 6% vanadium, up to about 10% cobalt, sufficient phosphorous in the range more than about 0.03% to about 0.20% phosphorous to provide improved cutting tool life as compared with a like tool having less than 0.03% phosphorous and the balance iron with residual impurities in ordinary amounts, said tool being characterized by improved tool life and cutting performance.

* * * * *

UNITED STATES PATENT AND TRADEMARK OFFICE

CERTIFICATE OF CORRECTION

PATENT NO. : 4,168,159

DATED : September 18, 1979

INVENTOR(S) : RENE SCHLATTER, DAVID P. HUGHES and JAMES STEPANIC

It is certified that error appears in the above-identified patent and that said Letters Patent are hereby corrected as shown below:

Claim 4, column 4, line 17, "chomium" should read --chromium--.

Signed and Sealed this

*Twenty-second* Day of *January 1980*

[SEAL]

*Attest:*

SIDNEY A. DIAMOND

*Attesting Officer*

*Commissioner of Patents and Trademarks*